United States Patent [19]

Teumer et al.

[11] 3,988,060

[45] Oct. 26, 1976

[54] BEAD BYPASS SPEED REDUCTION

[75] Inventors: Roger G. Teumer, Fairport; Earl V. Jackson; Herman A. Hermanson, both of Penfield; Le Roy Baldwin, Rochester, all of N.Y.

[73] Assignee: Xerox Corporation, Stamford, Conn.

[22] Filed: June 4, 1974

[21] Appl. No.: 476,186

[52] U.S. Cl. ..... 355/3 P

[51] Int. Cl.[2] ..... G03G 15/00

[58] Field of Search ..... 204/181, 299 PE, 300 PE; 354/297, 301, 303, 318; 355/3 R, 3 P, 10, 12, 16

[56] References Cited

UNITED STATES PATENTS

| | | | |
|---|---|---|---|
| 3,556,784 | 1/1971 | Robinson et al. | 355/10 X |
| 3,640,204 | 2/1972 | Gordon | 354/318 X |
| 3,697,409 | 10/1972 | Weigl | 355/3 P X |
| 3,723,288 | 3/1973 | Weigl | 204/300 PE |
| 3,761,174 | 9/1973 | Davidson | 355/16 |

*Primary Examiner*—Fred L. Braun
*Attorney, Agent, or Firm*—James J. Ralabate; Michael H. Shanahan; Charles E. Smith

[57] ABSTRACT

A system for separating one surface, preferably a web, from another surface to enable a bead of accumulated material built up at the line of contact between the two surfaces to pass therebetween. During the separation period, the advancing velocity of at least one surface is reduced so that at least one surface is advanced at a slower rate than its rate prior to separation, or stopped. In a preferred embodiment, the system is employed in photoelectrophoretic imaging to bypass a bead of imaging suspension built up at the imaging nip during separation of two webs immediately after completion of imaging to thereby permit dissipation or passage of the liquid bead. During the separation period, the surface, preferably a web, which does not carry the desired image, is advanced at a slower rate than its prior rate and slower than the other surface, or stopped.

9 Claims, 5 Drawing Figures

BEAD BYPASS SPEED REDUCTION

BACKGROUND OF THE INVENTION

This invention relates in general to accumulated material bead bypass and web control systems and, more particularly, their use in an improved photoelectrophoretic imaging system.

In the photoelectrophoretic imaging process monochromatic including black and white or full color images are formed through the use of photoelectrophoresis. An extensive and detailed description of the photoelectrophoretic process is found in U.S. Pat. Nos. 3,384,488 and 3,384,565 to Tulagin and Carreira; 3,383,933 to Yeh and 3,384,566 to Clark, which disclose a system where photoelectrophoretic particles migrate in image configuration providing a visual image at one or both of two electrodes between which the particles suspended within an insulating carrier is placed. The particles are electrically photosensitive and are believed to bear a net electrical charge while suspended which causes them to be attracted to one electrode and apparently undergo a net change in polarity upon exposure to activating electromagnetic radiation. The particles will migrate from one of the electrodes under the influence of an electric field through the liquid carrier to the other electrode.

The photoelectrophoretic imaging process is either monochromatic or polychromatic depending upon whether the photosensitive particles within the liquid carrier are responsive to the same or different portions of the light spectrum. A full-color polychromatic system is obtained, for example, by using cyan, magenta and yellow colored particles which are responsive to red, green and blue light respectively.

In photoelectrophoretic imaging generally, and as employed in the instant invention, the important broad teachings in the following four paragraphs should be noted.

Preferably, as taught in the four patents referred to above, the electric field across the imaging suspension is applied between electrodes having certain preferred properties, i.e., an injecting electrode and a blocking electrode, and the exposure to activating radiation occurs simultaneously with field application. However, as taught in various of the four patents referred to above and Leubbe et al, U.S. Pat. No. 3,595,770; Keller et al, U.S. Pat. No. 3,647,659 and Carreira et al, U.S. Pat. No. 3,477,934; such a wide variety of materials and modes for associating an electrical bias therewith, e.g., charged insulating webs, may serve as the electrodes, i.e., the means for applying the electric field across the imaging suspension, that opposed electrodes generally can be used; and that exposure and electric field applying steps may be sequential. In preferred embodiments herein, one electrode may be referred to as the injecting electrode and the opposite electrode as the blocking electrode. This is a preferred embodiment description. The terms blocking electrode and injecting electrode should be understood and interpreted in the context of the above comments throughout the specification and claims hereof.

It should also be noted that any suitable electrically photosensitive particle may be used. Kaprelian, U.S. Pat. No. 2,940,847 and Yeh, U.S. Pat. No. 3,681,064 disclose various electrically photosensitive particles, as do the four patents referred to above.

In a preferred mode, at least one of the electrodes is transparent, which also encompasses partial transparency that is sufficient to pass enough electromagnetic radiation to cause photoelectrophoretic imaging. However, as described in Weigl, U.S. Pat. No. 3,616,390 both electrodes may be opaque.

Preferably, the injecting electrode is grounded and the blocking electrode is biased to provide the field for imaging. However, such a wide variety of variations in how the field may be applied can be used, including grounding the blocking electrode and biasing the injecting electrode, biasing both electrodes with different bias values of the same polarity, biasing one electrode at one polarity and biasing the other at an opposite polarity of the same or different value, that just applying sufficient field for imaging can be used.

The photoelectrophoretic imaging system disclosed in the above-identified patents may utilize a wide variety of electrode configurations including a transparent flat electrode configuration for one of the electrodes, a flat plate or roller for the other electrode used in establishing the electric field across the imaging suspension.

There has been recently developed a photoelectrophoretic imaging system which utilizes web materials, which optimally may be disposable. In this process, the desired, e.g., positive image is formed on one of the webs and another web will carry away the negative or unwanted image. The positive image can be fixed to the web upon which it is formed, or the image transferred to a suitable backing such as paper. The web which carries the negative image can be rewound and later disposed of. In such photoelectrophoretic imaging systems employing disposable webs, cleaning systems are not required.

In photoelectrophoretic imaging systems employing a web device configuration, there is the problem of two webs, for example, plastic type materials, moving in a controlled manner relative to each other within the imaging machine. Therefore, a system is desirable to insure that webs are controllably presented to the imaging zone and to each other in the imaging zone during the imaging process step. Also, it is desirable to remove any accumulation of excess liquid build-up at the line of contact between the web and other surface (which may be a web) to prevent bead material, at the trailing edge of an image, from flowing or otherwise extending into web areas to be used for subsequent images and thereby degrading the quality of subsequent images.

Apparatus in which surfaces including web materials are moved into and out of intimate pressure engagement for processing of film is generally known. For example, U.S. Pat. No. 3,640,204 to Gordon discloses a web processing device in which a web containing a processing ingredient or solution is brought into pressure engagement with an exposed film to effect processing of the film. This patent is not concerned with the problems overcome by the present invention, e.g., controlling the web presented in the imaging zone and/or eliminating excess liquid bead in the imaging zone.

A process for removing excess liquid developer from a photoconductive surface is the Pneumatic Assembly Liquid Removing method and apparatus disclosed by Smith et al in U.S. Pat. No. 3,741,643. In this pneumatic assembly liquid removing process, a system is provided wherein excess toner is removed from the photoconductive surface by means of apparatus that requires equipment that is expensive and complex in comparison with the instant invention.

In Mihajlov, U.S. Pat. No. 3,281,241, a bead of developer liquid is advanced across the surface of the imaging support member. There is no suggestion for employing the techniques of the instant invention.

In earlier photoelectrophoretic apparatus which sometimes encounters this bead of accumulated material, Egnaczak, Pat. No. 3,673,632 and Riley, Pat. No. 3,686,035 provide a slot in one of the surfaces to collect a bead, the slot being periodically emptied, to solve a similar problem. However, it may be impossible or impractical to employ a similar arrangement when using relatively thin webs as the surfaces.

In Hermanson copending application, Ser. No. 476,189 filed June 4, 1974, a Bead Bypass system generally, without specific claims to speed reduction, is disclosed.

SUMMARY OF THE INVENTION

Accordingly, it is an object of this invention to remove accumulations of materials between moving surfaces without the above noted disadvantages.

Another object of this invention is to improve cleaning techniques and means for the development of images of imaging systems.

A further object of this invention is to improve systems for removing accumulations of materials between two members moving relative to each other cyclically and automatically.

Still another object of this invention is to prevent or eliminate accumulations of materials from interfering with further images of an imaging system.

Another object of this invention is to improve photoelectrophoretic imaging systems employing a web device by eliminating image defects caused by accumulation of excess liquid beads at the line of contact between electrodes.

Yet another object is to provide a photoelectrophoretic web imaging system using a minimum amount of web material.

Yet another object is to provide a bead bypass system with a minimum amount of advancing surface by slowing or stopping at least one surface during the actual bead bypass which occurs when the surfaces are separated or approaching separation.

The foregoing objects and others are accomplished in accordance with this invention by a system for separating one surface, preferably from another surface, to enable a bead of accumulated material, built up at the line of contact between the two surfaces to pass therebetween. During the separation period, the advancing velocity of at least one surface is reduced so that at least one surface is advanced at a slower rate than its rate prior to separation, or stopped. In a preferred embodiment, the system is employed in photoelectrophoretic imaging to bypass a bead of imaging suspension built up at the imaging nip during separation of two webs immediately after completion of imaging to thereby permit dissipation or passage of the liquid bead. During the separation period, the surface, preferably a web which does not carry the desired image, is advanced at a slower rate than its prior rate and slower than the other surface, or stopped.

DESCRIPTION OF THE DRAWINGS

These and other objects and advantages of accumulated material bead bypass systems and web control systems and their use in improved photoelectrophoretic imaging systems will become apparent to those skilled in the art after reading the following detailed description taken in conjunction with the accompanying drawings wherein.

DESCRIPTION OF THE PREFERRED EMBODIMENTS

The invention, herein, is described and illustrated in specific embodiments having specific components listed for carrying out the functions of the apparatus. Nevertheless, the invention need not be thought of as being confined to such specific showings and should be construed broadly within the scope of the claims. Any and all equivalent structures and methods known by those skilled in the art can be substituted for the specific apparatus and methods disclosed as long as the substituted method and apparatus achieve a similar function. It may be that other methods and apparatus would be invented having similar needs to those fulfilled by the method and apparatus described and claimed herein, and it is the intention herein to describe an invention for use in apparatus other than the embodiment shown. For example, the invention hereof can be used in the Mihajlov U.S. Pat. No. 3,281,241 system to separate the web from the plate surface or any system or device wherein it is desirable to separate one surface from another to allow for the dissipation of a bead of accumulated material built up at the line of contact between the surfaces.

Figure 1:
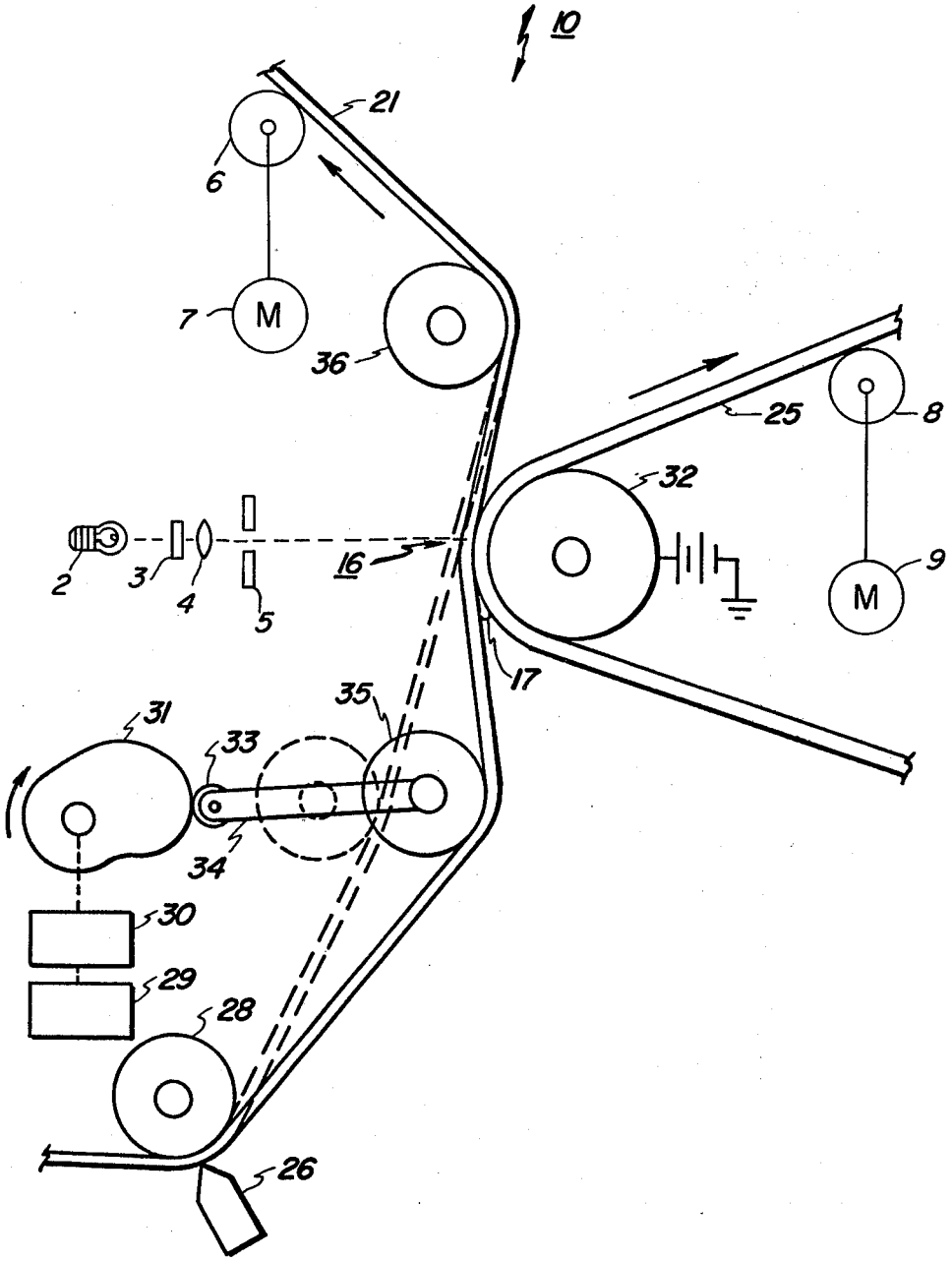
FIG. 1 is a side view, partially schematic drawing of a portion of a preferred photoelectrophoretic imaging apparatus employing one embodiment of this invention.

Referring now to the FIG. 1 embodiment of the invention, there is shown a portion of web configuration photoelectrophoretic imaging system for illustrating a preferred mode of this invention. There are problems attendant to the use of the web configuration in photoelectrophoretic imaging systems, some of which the present invention is designed to solve. The actual process steps of the web device configuration are basically the same process steps as used in photoelectrophoretic imaging systems described in patents referred to earlier and are incorporated by reference herein. The present description will be directed in particular to elements forming part of, or cooperating more directly with the present invention, elements of the photoelectrophoretic apparatus not specifically shown or described herein being understood to be selectable from those known in the art.

Still referring to the FIG. 1 embodiment of the invention, the web or member 25, referred to as the blocking web, is formed of an about 1 mil clear polypropylene blocking material. The web or member 21 referred to as the injecting web, is formed of an about 1 mil Mylar, a polyethylene terephthalate polyester film from DuPont, overcoated with a thin transparent conductive material, e.g., about 50% white light transmissive layer of aluminum. The conductive surface of the injecting web 21 is connected to ground at some convenient location within the system. As will be made clear from the explanation that will be given below, by analogy, the functions of the injecting web and the blocking webs, correspond to the functions of the injecting and blocking electrodes respectively, described in great detail in the four patents referenced earlier. The web device inking system includes the applicator 26 and a rigidly supported backup inking roller 28 mounted for rotation. The applicator 26 supplies a metered flow of ink that will provide a uniform ink coating of the desired thickness on the conductive side of the injecting web 21. In one instance, an ink film segment, approximately 1.25 mils thick and about 14 inches long in the longitudinal direction of the web is coated onto the injecting web.

At the start of the photoelectrophoretic imaging process, the injecting web 21 is driven in the direction of the arrow by a mechanical drive, such as, for example, a drive roller 6 which is connected to a motor 7, which accelerates the web to a constant speed between 3 – 20 inches per second, preferably about 5 inches per second. Before the layer of ink film reaches the imaging zone, generally designated as 16, the blocking web 25, driven in the direction of the arrow by an independent drive, such as, for example, a drive roller 8 which is connected to a motor 9, accelerates to a constant speed to match the speed of the injecting web. The two rollers, lower roller 35 and upper roller 36, are utilized to provide a stable web path for the injecting web 21 through the imaging zone 16, thus, serving as wrap rollers, without which the injecting web 21 would be left unsupported moving within the imaging zone 16. The lower roller 35 and upper roller 36 are spaced apart sufficiently to permit exposure to be made in the imaging zone through transparent injecting web 21 without obstructing the projected rays of illumination. Exposure is effected by means comprising a light source 2, transparency 3, lens 4 and scanning slit 5.

When the two webs are brought together at the imaging zone 16 to form the ink-web sandwich, the imaging roller 32, which may be formed, for example, of steel or conductive rubber, may be utilized to apply a uniform electrical imaging field across the ink-web sandwich. The combination of the pressure exerted by the imaging roller 32 and the electrical field across the ink-web sandwich tends to cause excess liquid suspension to be uniformly metered out of the sandwich, forming a "tailing" liquid bead 17 at the inlet to the imaging nip. Unless this liquid bead 17 clears the imaging nip, the bead will extend back into web portions in advance of the imaging zone to degrade the ink on those portions when subsequently used in the imaging zone. One method for avoiding the degrading of images from this effect would be to allow lengths of web materials, not coated with suspension, to pass through the imaging zone, after liquid bead build-up, sufficient to allow all traces of the tail to pass before an imaging sequence is repeated. This method would entail a time delay between images and would also result in a great deal of waste of web material.

The instant invention provides a simple and economical method and apparatus to eliminate this tailing liquid problem, without the above noted disadvantages. This invention further utilizes the lower and upper rollers 35 and 36, described herein-earlier in conjunction with the additional apparatus to provide the web separator system, generally designated 10, to accomplish this feature. The web separator system 10 functions to separate the two webs 21 and 25, having liquid suspension sandwiched between them, to allow the liquid bead formed at the line of contact between the webs to pass therebetween beyond the imaging areas between frames.

Separation of the webs may be accomplished in a variety of ways. In one exemplary example, shown in FIG. 1, web separation may be obtained at the desired time by camming the lower roller 35 to move from the imaging mode position to the bypass position or standby mode as indicated by the dotted line. In this bypass position, the clearance between the webs 21 and 25 is sufficient to permit the liquid bead build-up 17 at the nip entrance to advance on web 21 beyond the imaging zone. During the separation period, when the webs are out of contact, the speed of the injecting web 21 remains constant (e.g. advancing the web and the desired image formed thereon to desired image processing stations) but the speed of the blocking web 25 may be caused to automatically change to a stop or a slower standby speed to minimize the amount of web 25 used between imaging cycles.

During the period when the webs are separated out of contact with each other, the advancing velocity of the injecting web remains constant and the velocity of the blocking web may be shifted from the imaging mode to a reduced standby mode or stopped automatically in order to conserve blocking web material. The advancing rate of the blocking web may be reduced to variable speeds or stopped between imaging frames during continuous operation and during non-continuous operation, the blocking web may be stopped completely during the period when the webs are out of contact with each other at the nip in the imaging zone. As the separator roller begins to move outward to separate the webs, the arm or lifter which mounts the roller, automatically actuates a micro-switch abutting the arm as the arm begins to move as a result of the camming action. When the photoelectrophoretic imaging device is operated continuously, i.e., to reproduce a series of images, the micro-switch is coupled to a variable potentiometer which in conjunction with control means decreases the level of the magnitude of current supplied to the blocking web drive motor, thereby reducing the speed of the blocking web to a standby speed or stopping it. As the webs are brought together, the arm or lifter is moved in the opposite direction releasing the micro-switch and the blocking web accelerates to the imaging or process speed. In the case when the photoelectrophoretic imaging device is operated non-continuously, i.e., a single image is reproduced, the micro-switch is coupled to the blocking web drive supply and when actuated turns off the power supplied to blocking web drive thereby stopping the blocking web completely. Of course in some modes and for some uses of the instant invention, both surfaces may be slowed down or stopped when the surfaces are separated.

Initiation of the camming cycle of the lower roller 35 is provided by the control means 29 which cooperates with the constant speed A.C. motor 30 to rotate the cam 31 at the desired rate of speed. The camming cycle is adjustable by the control means 29 and is in phase with imaging cycle. It will be appreciated that the same camming elements described with regard to roller 35 may, alternatively, be applied in the same manner with regard to the roller 36. Web separation is begun just upon completion of the application of imaging field and the next field applied coincides with the re-forming of the ink-web sandwich at the imaging zone and exposure. It is also advantageous that the end of ink film application is in phase with the camming cycle. For example, during the separation period, when the webs are out of contact with the ink, the ink applicator would be turned off and those web portions traveling through the imaging zone would be devoid of ink.

Figure 2:
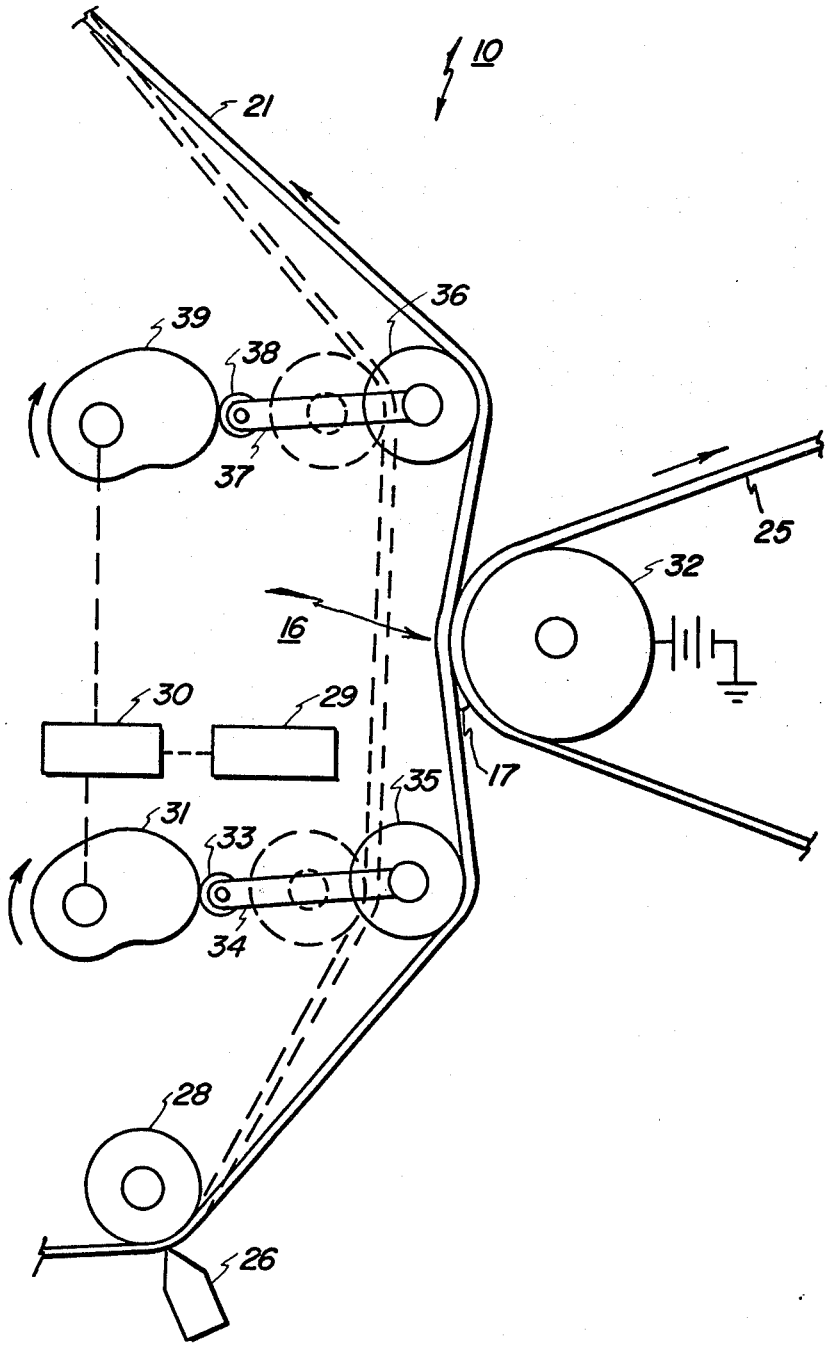
FIG. 2 is a side view, partially schematic drawing of a preferred alternative embodiment according to this invention.

Referring now to the FIG. 2, there is shown an alternative embodiment of this invention. The embodiment shown in FIG. 2, uses identical numerals to identify identical elements of the device and is similar to the FIG. 1 embodiment of the invention. Therefore, only these elements not previously described need mentioning. The A.C. motor 30 is coupled to the cam 39 as well as cam 31. The cam 39 operates in phase with cam 31, on the cam follower 38, through the lifter 37 to move the upper roller 36 simultaneously with the movement of the lower roller 35. With these noted exceptions, operation for the embodiment of FIG. 2 is identical to the operation of the embodiment of FIG. 1.

Figure 3:
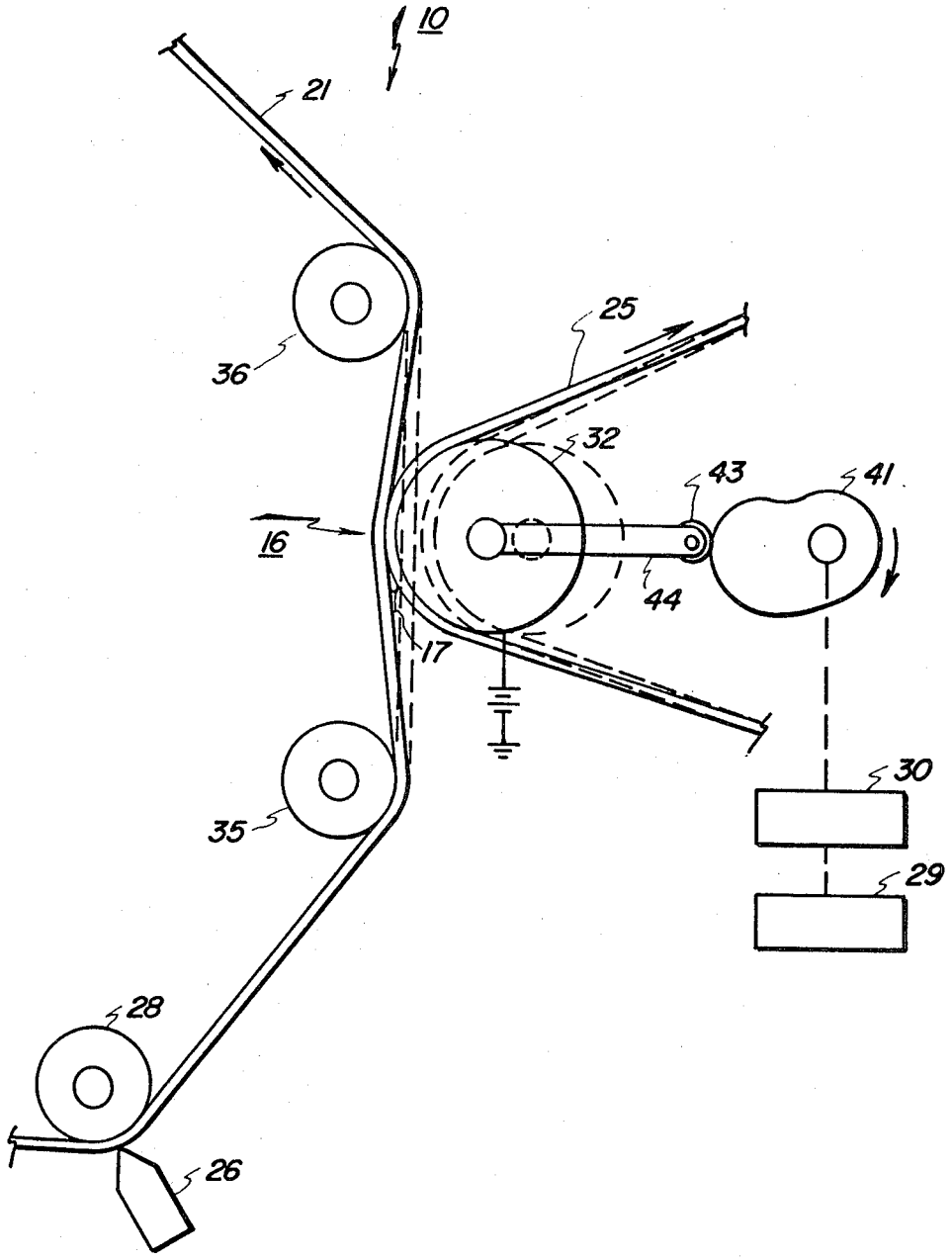
FIG. 3 is a side view, partially schematic drawing illustrating still another preferred alternative embodiment of this invention.

Referring now to FIG. 3, there is shown still another alternative embodiment for illustrating this invention. The embodiment shown in FIG. 3 uses identical numerals to identify identical parts of the device and is similar to the FIGS. 1 and 2 embodiments of the invention with the exception noted below.

In the FIG. 3 embodiment of the invention, the imaging roller 32 is used as the camming roller to achieve web separation. The cam 41 cooperates with the cam follower 43 and the lifter 44 to move imaging roller 32 between the imaging mode position and the bead bypass position or standby mode in the same manner as described hereinearlier with regard to the lower and upper rollers 35 and 36 respectively.

The photoelectrophoretic imaging system above, generally employs flexible webs as the injecting and blocking electrodes. As will be recalled, the photoelectrophoretic imaging system may utilize a variety of electrode configurations including a transparent flat plate or roller for the other electrode used in establishing the electric field across the imaging suspension. The foregoing methods for dissipating the bead of accumulated material built up between the surfaces may also be utilized in photoelectrophoretic imaging systems employing these configurations.

Figure 4A:
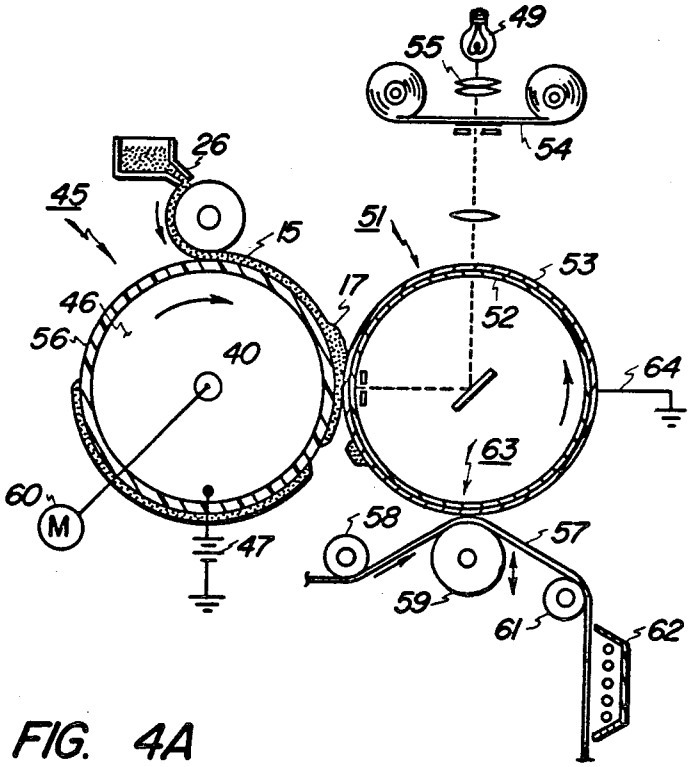
FIGS. 4 and 4*a* are side views, partially schematic drawings illustrating other preferred alternative embodiments of this invention.
Figure 4:
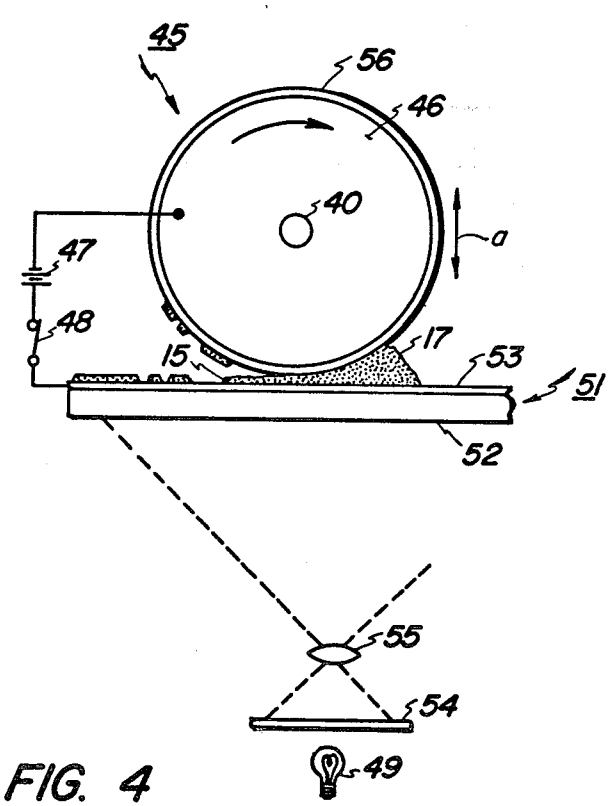

Referring now to FIG. 4, there is seen a transparent injecting electrode generally designated 51 which, in this exemplary instance, is made up of a layer of optically transparent glass 52 overcoated with a thin optically transparent layer 53 of tin oxide, commercially available under the name NESA glass. Coated on the surface of the injecting electrode 51 is a thin layer of imaging suspension 15 and above the imaging suspension is a blocking electrode 45 in the form of a roller having a conductive central core 46 connected to a potential source 47 through a switch 48. The opposite side of the potential source 47 is connected to the injecting electrode 51 so that when the switch 48 is closed an electric field is applied across the imaging suspension 15 from electrodes 51 and 45. The core 46 is covered with a layer of suitable blocking electrode material 56. An image projector made up of a light source 49 and a transparency 54, and a lens 55 is provided to exposure the suspension 15 to a light image of the original transparency 54 to be reproduced. It should be noted at this point that injecting electrode 51 need not necessarily be optically transparent but that instead electrode 45 may be optically transparent and exposure may be made through its as explained in greater detail in the four patents referred to earlier.

The embodiment shown in FIG. 4*a* uses identical numerals to identify identical parts and is similar to the FIG. 4 embodiment of the invention except primarily, for the fact that both the transparent injecting electrode 51 and the blocking electrode 45 are in the form of a roller.

In both FIG. 4 and FIG. 4*a* embodiments of the invention, generally as the blocking electrode 45 rolls into contact with the suspension 15 coated injecting electrode 51, a bead of suspension 17 tends to build up at the entrance to the interface. Since the excess portion of suspension in the accumulated bead 17 goes to waste rather than forming an image, it causes ineffecient use of the imaging suspension. If the bead is allowed to accumulate in front of the approaching electrodes, it may have deleterious effects upon the formation of the image reproduced because of dilution of the imaging suspension. By separating the electrodes 51 and 45, having liquid suspension sandwiched between them, the accumulated liquid bead 17 formed at the line of contact between the electrodes, is allowed to pass therebetween beyond the imaging areas between frames. The roller shaft 40, driven by the drive means 60, rotates the blocking electrode 45 thereby moving it into interface with the injecting electrode 51 during imaging. Separation of the electrodes 51 and 45 may be obtained at the desired time by disengaging the blocking electrode 45 from the injecting electrode by moving the roller shaft 40 in the direction of the arrow a, say for example, with apparatus described hereinearlier with regard to the FIG. 3 embodiment of the invention.

The techniques that have been described herein for the removal of accumulated material from the entrance to the nip of at least two surfaces in the photoelectrophoretic imaging zone, may also be utilized in a similar fashion in the transfer zone. In this regard, reference is made to the FIG. 4*a* embodiment of the invention. The image formed on the surface of the injecting electrode 51 is carried to the transfer zone 63 into contact with an adhesive copy web 57. The copy web is entrained around two idler rollers 58 and 61, and the transfer roller 59, positioned between the idler rollers. During the transfer step, excess liquid material may build up at the line of contact between the drum surface and the web 57. The transfer roller 59 may be utilized to separate the web 57 from the drum surface to thereby dissipate the bead of accumulated material, by moving the roller 59 in the direction of the arrow, say for example, by means of apparatus described earlier with regard to the FIG. 1 embodiment of the invention.

Other modifications of the above described invention will become apparent to those skilled in the art and are intended to be incorporated herein.

What is claimed is:

1. Apparatus for photoelectrophoretic imaging comprising a. means for removing a bead of accumulated photoelectrophoretic imaging suspension of electrically photosensitive particles in a carrier liquid from the entrance of a nip region formed by two members, each of said members having inside surface with respect to the nip, wherein successive portions of the inside surfaces move into contact with each other at the nip comprising i means for advancing said successive portions of said members into contact with each other at the nip including means to advance at least one of said surfaces relative to the nip region so that any bead portion carried on said at least one surface is advanced beyond the nip region when the surfaces are separated from contacting engagement with each other other;

ii means for separating said surfaces at the nip to a spacing suffficient to allow a bead of accumulated photoelectrophoretic imaging suspension to pass the nip region; and iii means for reducing the advancing velocity of at least one of said surfaces during said separation so that said at least one surface is advanced at a slower rate than its rate prior to separation;

b. means for coating a photoelectrophoretic imaging suspension on successive portions of the inside surface of at least one of said surfaces before said surfaces are brought into contact to form the nip;

c. means for applying an electrical field across said imaging suspension at least when said surfaces are in contact at the nip with the imaging suspension therebetween; and d. means for imagewise exposing said suspension at the nip to an image of activating electromagnetic radiation at least when said surfaces are in contact at the nip with the imaging suspension therebetween.

2. Apparatus according to claim 1 wherein said means for separating includes camming means including a cam follower connected to a lifter arm which is connected to a roller which is in contact with outside portions of one of said members.

3. Apparatus according to claim 2 wherein said means for reducing the velocity includes switching means coupled to said advancing means, said switching means being located so as to be activated by said lifter arm when said camming means is operated to separate said surfaces.

4. Apparatus according to claim 1 wherein at least one of said members is transparent and wherein said imagewise exposure is through said transparent member.

5. Apparatus according to claim 1 wherein each of said members is a web.

6. Apparatus according to claim 5 wherein one web is an injecting electrode which is transparent and the other web is a blocking electrode, the advancing velocity of said blocking electrode being reduced during said separation.

7. Apparatus according to claim 6 wherein said means for reducing the advancing velocity includes means for stopping movement of said blocking electrode web only after portions of the bead contained thereon are advanced past the nip region.

8. Apparatus according to claim 6 wherein said means for advancing is adapted to advance said webs at a speed between 3 to about 20 inches per second during contact.

9. Apparatus according to claim 8 wherein said means for advancing is adapted to maintain the speed of said injecting web constant during separation and during contact.

* * * * *